US007465863B2

(12) United States Patent
Nishida

(10) Patent No.: US 7,465,863 B2
(45) Date of Patent: Dec. 16, 2008

(54) KEYBOARD APPARATUS

(75) Inventor: Kenichi Nishida, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 337 days.

(21) Appl. No.: 11/489,991

(22) Filed: Jul. 19, 2006

(65) Prior Publication Data

US 2007/0017341 A1 Jan. 25, 2007

(30) Foreign Application Priority Data

Jul. 21, 2005 (JP) ..... 2005-211752

(51) Int. Cl.
*G10D 13/02* (2006.01)

(52) U.S. Cl. ..... 84/423 R

(58) Field of Classification Search ..... 84/423 R, 84/477 R, 478, 430–438, 441, 423 A
See application file for complete search history.

(56) References Cited

U.S. PATENT DOCUMENTS 5,834,668 A 11/1998 Kumano et al.
2006/0070515 A1* 4/2006 Funaki et al. ..... 84/745

* cited by examiner

*Primary Examiner*—Kimberly R Lockett
(74) *Attorney, Agent, or Firm*—Morrison & Foerster LLP

(57) ABSTRACT

A keyboard apparatus includes: keys composed of white keys and black keys supported pivotably on a key mounting part of a frame; mass members pivotably supported on a mass member mounting part and driven by mass member driving parts provided underside of the keys; and a mass member lower limit stopper and a mass member upper limit stopper restricting a pivot range of the mass members. Each of the mass members includes a mass concentration part. The mass concentration part extends more outward in a key longitudinal direction than a position where the mass member upper limit stopper on the frame is disposed, and an upper face of the mass concentration part at its highest lifted position is substantially flush with an upper face of a rear end portion of the white key main body.

7 Claims, 9 Drawing Sheets

KEYBOARD APPARATUS

BACKGROUND OF THE INVENTION

1. Field of the Invention

The invention relates to a keyboard apparatus used in electronic keyboard instruments such as an electronic organ, an electronic piano, and a synthesizer, or in electric keyboard instruments.

2. Description of the Related Art

Some of conventional keyboard apparatuses used in electronic keyboard instruments such as electronic organs and electronic pianos also include mass members generally called hammers in correspondence to respective keys, so as to provide a heavy touch feeling close to a key touch feeling of an acoustic musical instrument such as a piano. The hammers pivot in linkage with a key depression operation of the respective keys to give a force depending on their movement as a reactive force against a key depression force, thereby providing a desired key depression touch feeling.

The hammers are generally formed of a metal material and extend linearly backward in a key longitudinal direction from pivotal fulcrum parts. As for an inertia moment, the relation of $I=ma^2$ holds, where "I" is an inertia moment, "m" is a mass of the hammer and "a" is a distance from a pivotal fulcrum to a mass center (gravity center), and a touch feeling at the time of key depression can be made heavy by the inertia moment I. Therefore, even with the same mass "m", the longer the distance "a" is, the larger mass feeling (equivalent mass) a finger receives.

Therefore, in a case where the hammers extend linearly, since the mass distribution thereof is uniform, it is not possible to secure a sufficient mass and a sufficient distance from the pivotal fulcrum to the gravity center unless the total length of each of the hammers is made long. Therefore, it is necessary to make the total length of the hammer long in order to obtain a desired touch feeling, which has posed a problem of increased depth of the keyboard apparatus.

Under such circumstances, also known is that a mass concentration part is formed by bending a rear end portion of a hammer made of a bar-shaped metal material so as to fold back the rear end portion forward, as disclosed in, for example, U.S. Pat. No. 5,834,668 B. This structure can shorten the total length of the hammer even with the same mass and shift a position of the gravity center closer to the rear end portion far from a pivotal fulcrum, thereby increasing the aforesaid equivalent mass. Consequently, it is possible to obtain a desired touch feeling without any increase in depth of a keyboard apparatus.

However, in a conventional keyboard apparatus including such hammers, an upper limit of the pivoting of the hammer is restricted in such a manner that the mass concentration part in its rear end portion touches with a mass member upper limit stopper provided near a rear end of a frame being a support member when the hammer pivots in linkage with a key at the key depression time. Since the bar-shaped metal material in the mass concentration part is folding back upward, the vicinity of a rear end of the folded part touches with the mass member upper limit stopper so that the pivoting is restricted. Therefore, it is necessary to position the mass member upper limit stopper as high as possible in order to allow the hammer to pivot at a sufficiently large angle for the purpose of obtaining a desired touch feeling.

In such a structure, the rear end portion of a frame has to be extended backward and made high, which poses a problem that not much reduction in depth of the keyboard is realized and the rear end portion becomes high. Moreover, increasing the length of the folded part of the mass concentration part for the purpose of increasing the mass of the hammer causes the position of the gravity center to shift closer to the pivotal fulcrum, which poses another problem that the aforesaid equivalent mass does not increase so much, resulting in a small effect of improving a touch feeling.

SUMMARY OF THE INVENTION

The invention was made to solve the problems as described above, and an object thereof is to provide a keyboard apparatus including mass members (hammers), in which the mass members are reduced in total length and yet has a sufficient equivalent mass and the mass members pivot at a larger angle at the time of key depression to provide a desired touch feeling, without increasing depth and height of the keyboard apparatus.

The invention is a keyboard apparatus including: a frame having a key mounting part and a mass member mounting part; keys composed of white keys and black keys that are pivotably supported on the key mounting part via key pivoting parts; mass members that are driven by driving parts provided underside of the keys and are supported pivotably on the mass member mounting part via mass member pivoting parts; and a mass member lower limit stopper and a mass member upper limit stopper that are provided on the frame to restrict a pivot range of the mass members when the keys are driven and when the keys are not driven, and the following structure is adopted in order to attain the above object.

That is, each of the mass members includes a mass concentration part that extends more outward in a key longitudinal direction than a position where the mass member upper limit stopper of the frame is disposed, and an upper face of the mass concentration part at a highest lifted position is substantially flush with an upper face of a main body rear end portion of the white key.

Alternatively, in a keyboard apparatus including a support member; keys pivotably supported on the support member; and mass members that are provided below the keys to be pivotably supported on the support member and is driven to pivot via driving parts provided underside of the keys, the following structure may be adopted in order to attain the above objects.

That is, each of the mass members includes: an inertia moment generating part made of a bar-shaped metal material with a predetermined length; and a driving force transmitting part which includes a driven part driven by the driving part and a supported part pivotably supported and whose length from a pivotal fulcrum is shorter than a length of the inertial moment generating part.

The inertial moment generating part is composed of a mass concentration part and a connecting part connecting the mass concentration part to the driving force transmitting part, and the mass concentration part extends more outward in a key longitudinal direction than a mass member upper limit stopper restricting an upper limit of pivoting of the mass members and has an upward extension part that extends upward along a pivot direction of the mass members.

In this keyboard apparatus, preferably, the mass concentration part further has a parallel part folded from the upward extension part toward the connecting part. A side shape of the mass concentration part in this case can be any of various shapes such as a C-shape, a hook shape, a quadrangular shape, and a triangular shape.

Alternatively, the mass concentration part may be formed by bending the bar-shaped metal material to a circular shape or to an arc shape in a vertical plane including the connecting part. A side shape of the mass concentration part in this case includes a circular shape (loop shape), a semicircular shape, a U-shape, a spiral shape, and the like.

Another possible structure is such that a plurality of the keys are pivotably supported on the support member and the mass members are provided in correspondence to the plural keys respectively, and depending on each group of the plural keys or depending on each of the keys, at least one of an effective length (length in a stretched state) and a shape of the mass concentration part in the corresponding mass member is made different for key scaling.

In this case, preferably, an equivalent mass of the mass member corresponding to a key or a key group in a lower register side is larger and an equivalent mass of the mass member corresponding to a key or a key group in a higher register side is smaller. Alternatively, the equivalent mass being a mass feeling that the mass member corresponding to the white key gives to a finger may be larger than an equivalent mass of the mass member corresponding to the black key.

Still another possible structure is such that: the mass concentration part of the mass member is provided at a position which is opposite the driving part across a corresponding part of the mass member pivoting part and whose distance from the corresponding part is longer than a distance between the corresponding part and the driving part; the mass concentration part extends more outward in a key longitudinal direction -than a position of the frame where the mass member upper limit stopper is disposed; and an upper face of the mass concentration part at a highest lifted position is positioned between an upper face of the white key main body and a lower face of a support part supporting the mass member upper limit stopper on the frame.

Another possible structure is such that the mass concentration part of the mass member is provided at an outermost portion that is the farthest position from a corresponding part and is opposite the driving part across the corresponding part of the mass member pivoting part, and whose distance from the corresponding part is longer than a distance between the corresponding part and the driving part, and the mass member has a rising part rising from the outermost portion.

When the mass concentration part is at a highest lifted position, the rising part is positioned higher than the mass member upper limit stopper, with an upper end thereof being lower than an upper face of the black key main body.

In the keyboard apparatus according to the invention, the mass concentration part of the mass member extends more outward than the position where the mass member upper limit stopper on the frame or the support member is disposed, so that it is possible to freely change the shape of the mass concentration part by a thickness between the mass member upper limit stopper and the upper face of the key, which increases the mass of the mass concentration part. Thereby, it is possible to increase the distance from the pivot center to the mass center or gravity center (i.e., increase the equivalent mass) while reducing the total length of the mass member, and increasing an inertia moment of the mass member. Further, a not extending upward portion in the mass member closer to the pivot center than the mass concentration part touches with the mass member upper limit stopper, whereby the upper limit position of the mass member is restricted at the key depression time, which achieves a larger pivotal angle as well. Therefore, a key touch feeling at the time of key depression can be made heavy, which makes it possible to easily obtain a desired touch feeling.

Moreover, since the rear end portion of the mass member even at the highest lifted position does not protrude upward from the upper face of the key, a keyboard backward portion can be made flat and low in height, and since the total length of the mass member need not be made long, there is no increase in depth of the keyboard apparatus. Therefore, a scope of mounting design could be enhanced, so that it is possible to provide a small, and high-performance keyboard instrument.

Incidentally, if the mass concentration part is formed by bending the bar-shaped metal material upward in the vertical plane including the connecting part connecting the driving force transmitting part and the mass concentration part, there is no portion extending in a key width direction, which can totally eliminate the interference with the mass members for the adjacent keys and enables an effective use of an upper space.

Further, key scaling of a key touch feeling can be made by adjusting an inertial moment in a unit of each key or in a unit of each key range.

The above and other objects, features and advantages of the invention will be apparent from the following detailed description which is to be read in conjunction with the accompanying drawings.

DETAILED DESCRIPTION OF THE PREFERRED EMBODIMENTS

Hereinafter, the best mode for carrying out the invention will be concretely described based on the drawings.

Figure 1:
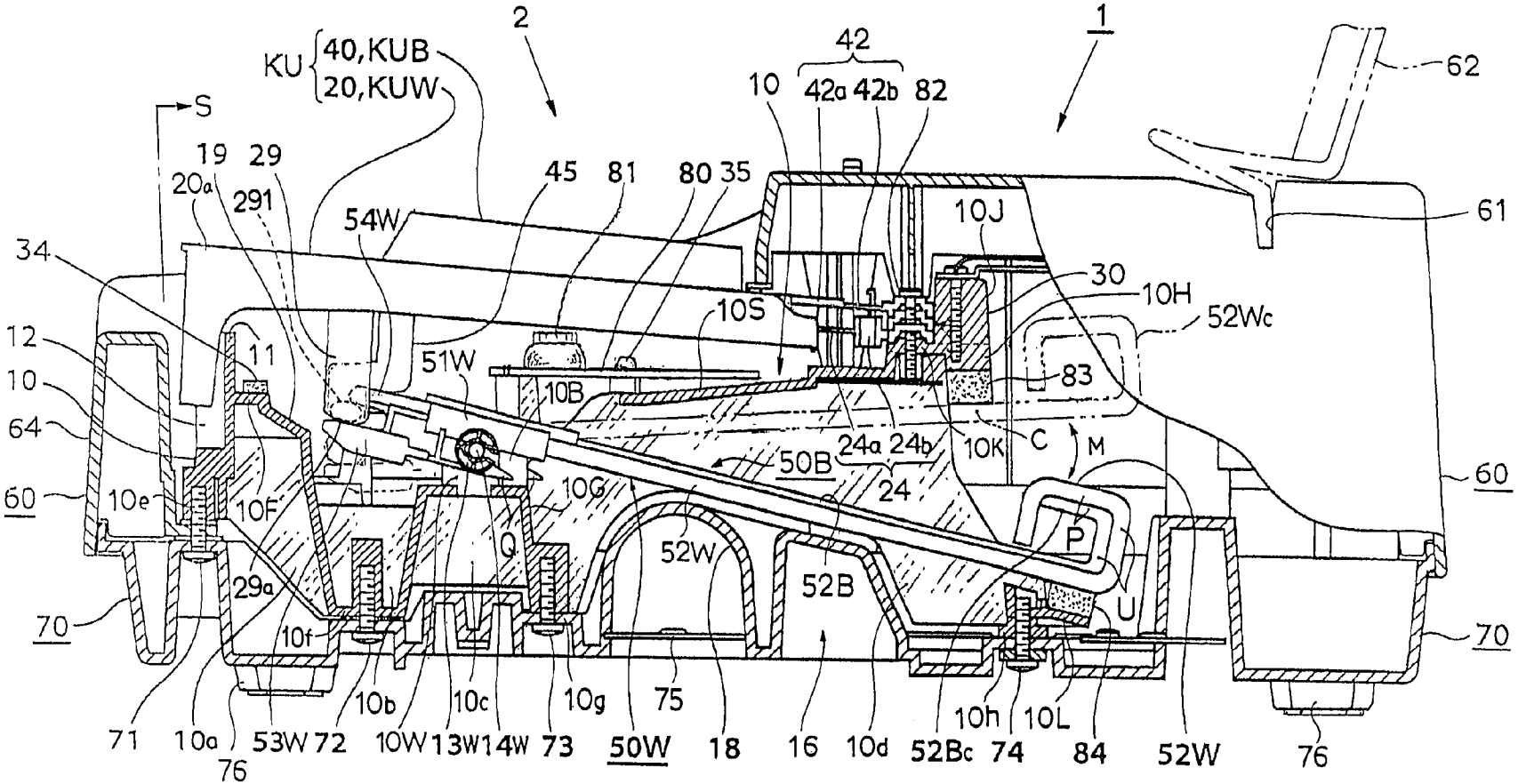
FIG. 1 is a rough cross-sectional view taken along a key longitudinal direction of an electronic musical instrument including a keyboard apparatus being one embodiment of the invention.
Figure 2:
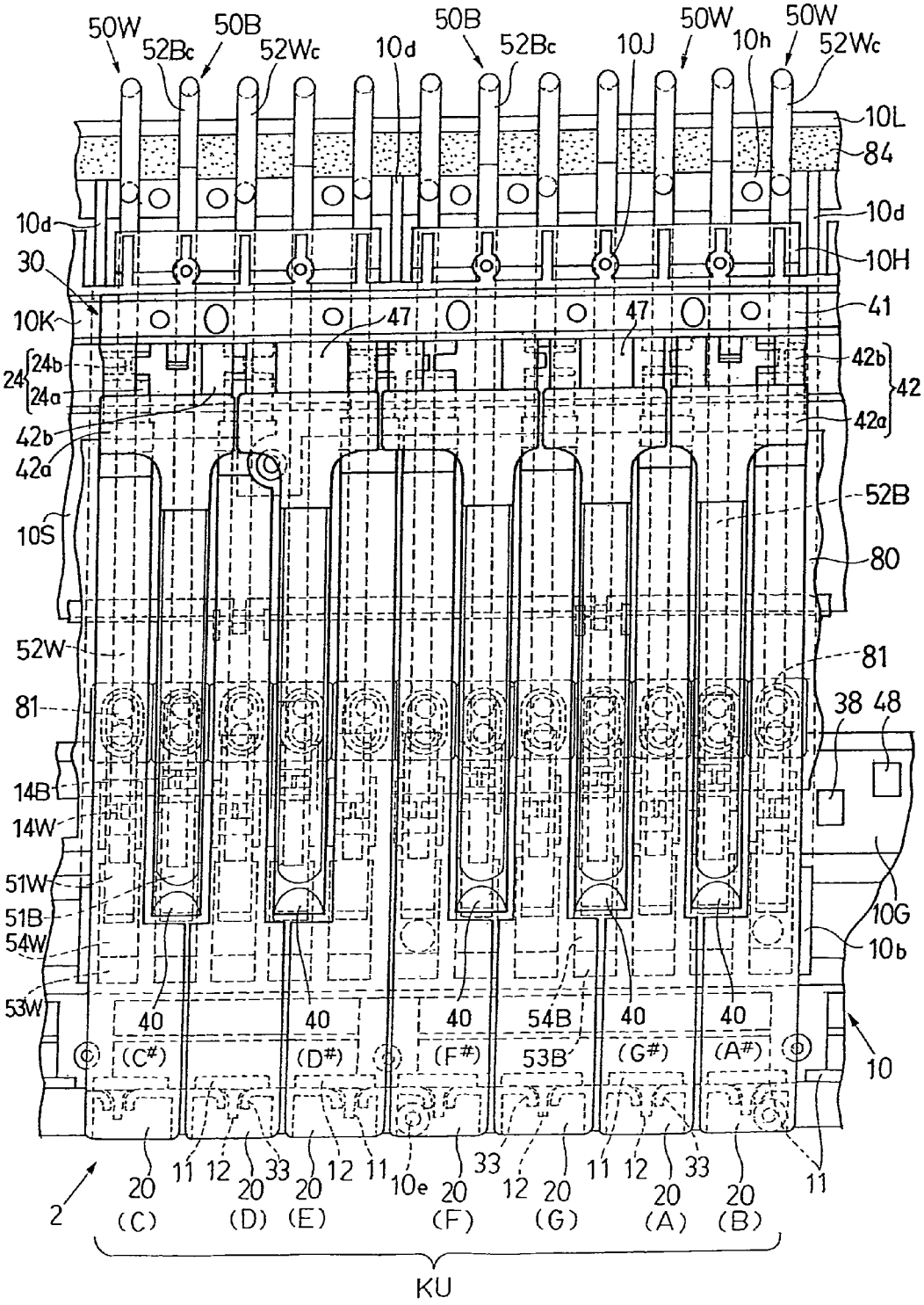
FIG. 2 is a plane view of a one-octave key range portion of the keyboard apparatus.
Figure 3:
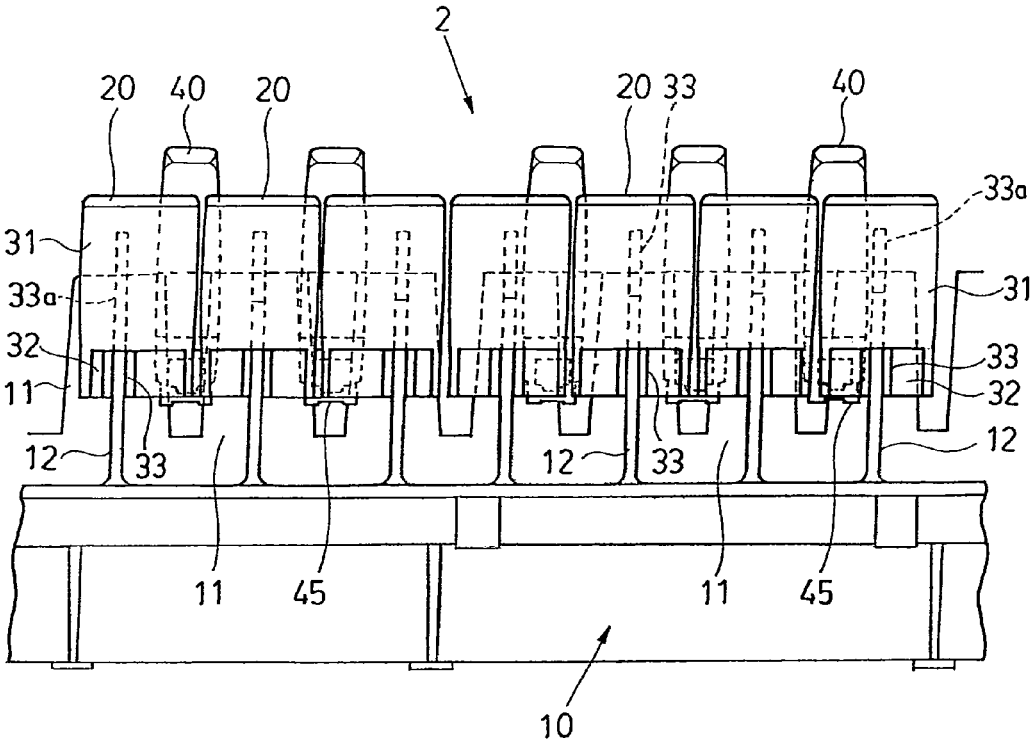
FIG. 3 is a front view of the same.
Figure 4:
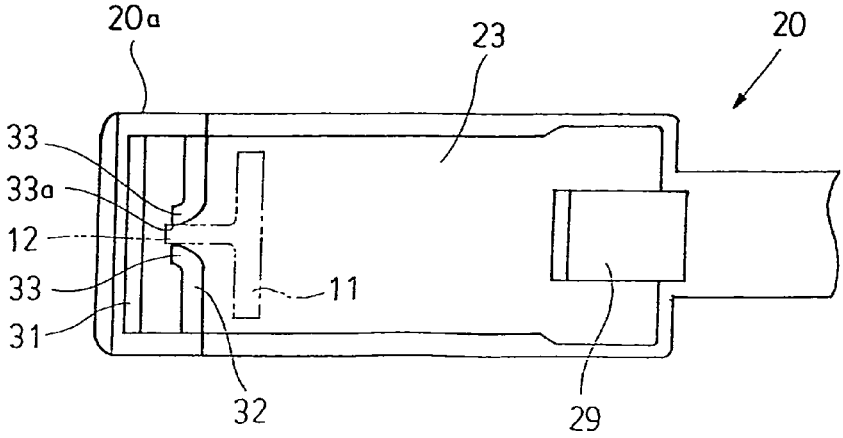
FIG. 4 is a bottom view of a free end side of a white key of the keyboard apparatus.

FIG. 1 to FIG. 10 are views showing one embodiment of the invention. FIG. 1 is a rough cross-sectional view taken along a key longitudinal direction of an electronic musical instrument including a keyboard apparatus according to the invention, FIG. 2 is a plane view of a one-octave key range portion of the keyboard apparatus, FIG. 3 is a front view seen from an arrow S direction in FIG. 1, and FIG. 4 is a bottom view of a free end side of a white key.

Figure 5:
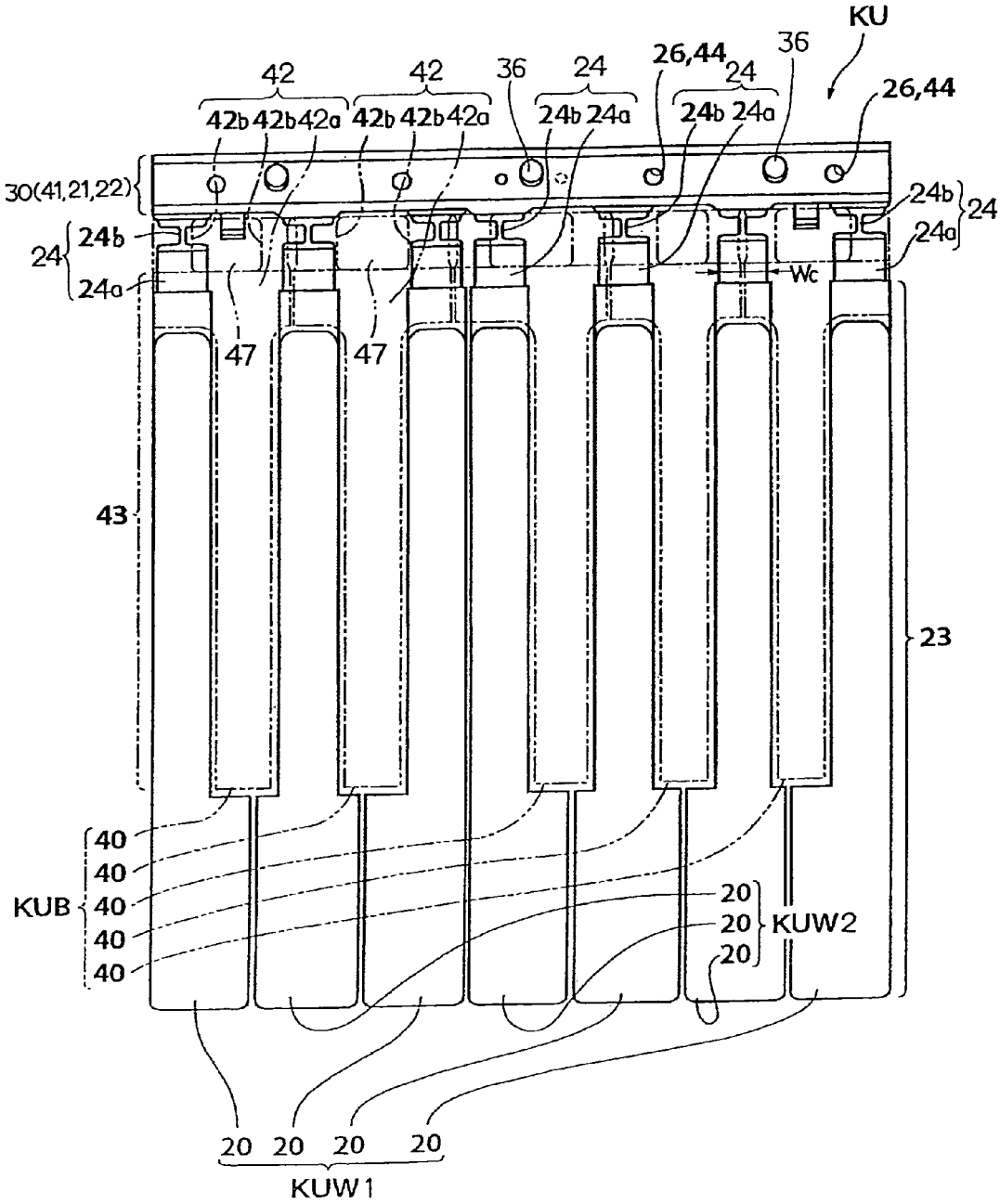
FIG. 5 is a plane view showing only a key unit of the keyboard apparatus, white key units thereof being shown by the solid line and a black key unit thereof being shown by the virtual line.
Figure 6:
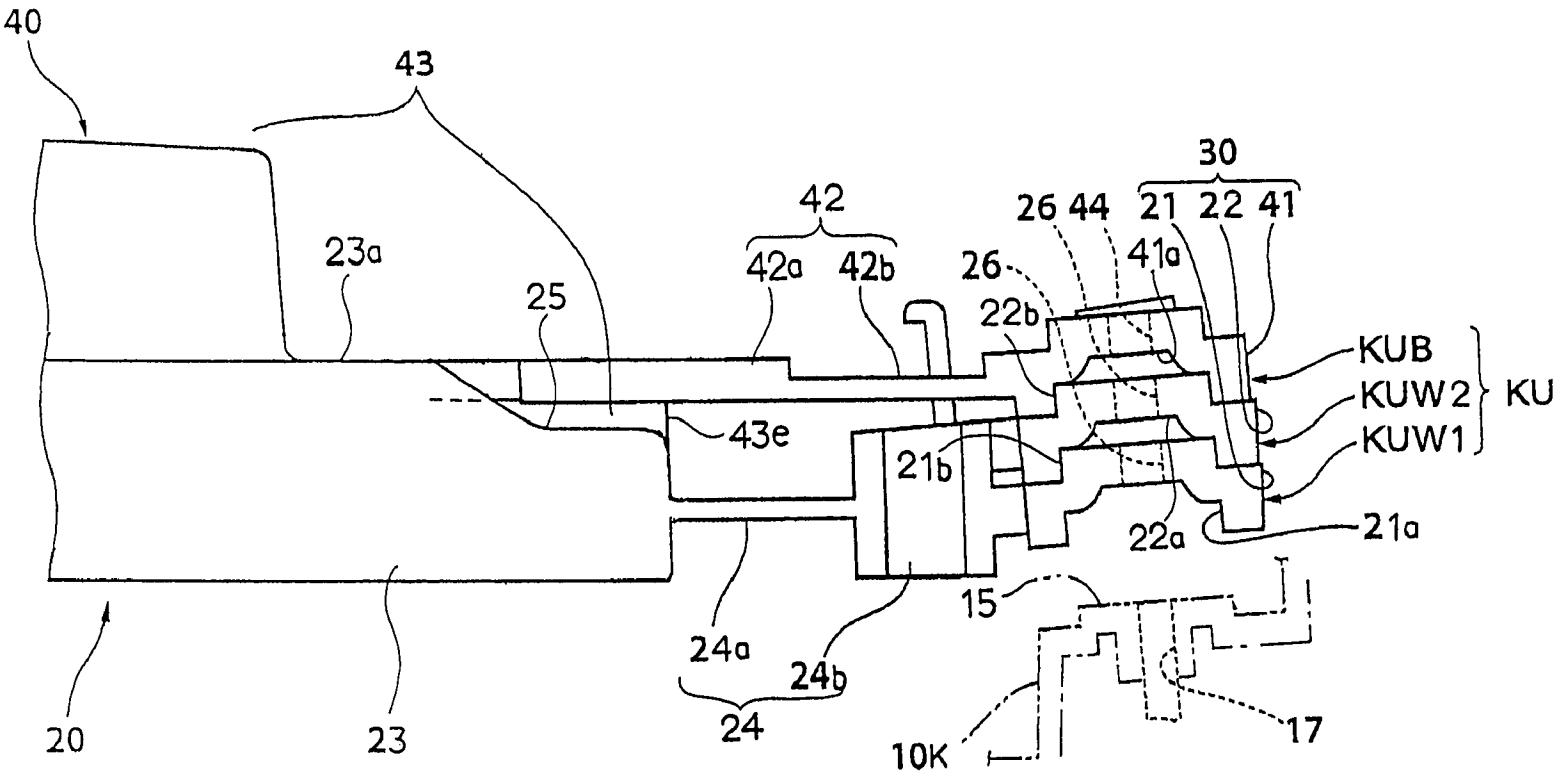
FIG. 6 is an enlarged side view of the vicinity of a common key support part of the key unit.
Figure 7:
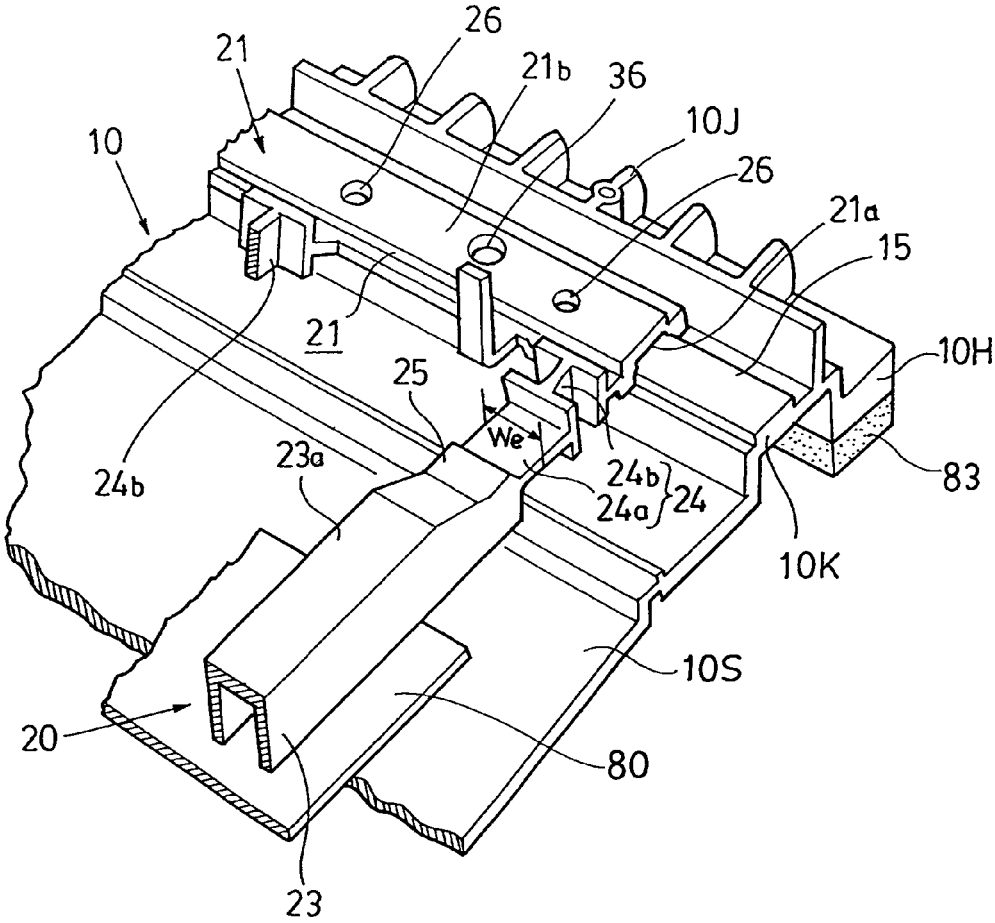
FIG. 7 is a perspective view showing the vicinity of a key mounting part of a frame of the keyboard apparatus and part of a first white key unit mounted thereon.
Figure 8:
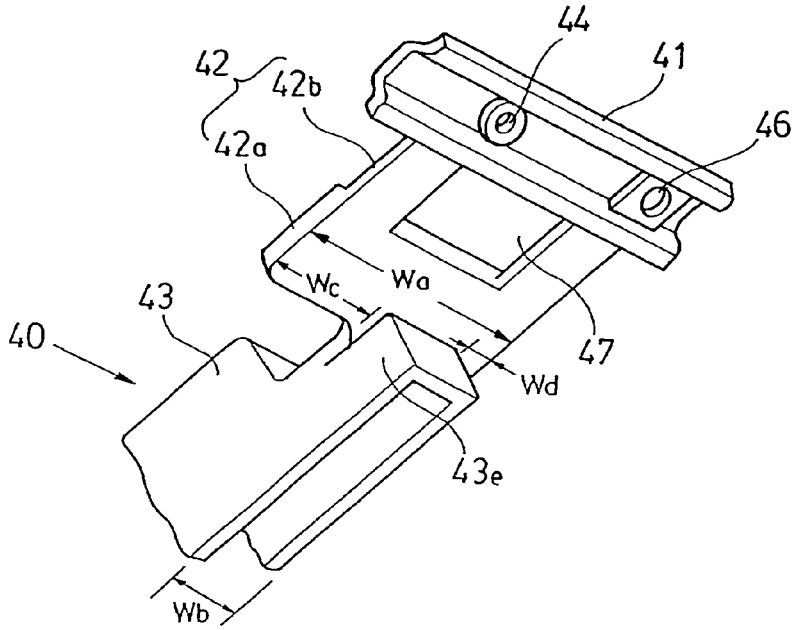
FIG. 8 is a perspective view of part of the black key unit seen from under.

FIG. 5 is a plane view showing only a key unit constituting the keyboard apparatus, white key units thereof being shown by the solid line and a black key unit thereof being shown by the virtual line. FIG. 6 is an enlarged side view showing the vicinity of a common key support part of the key unit, FIG. 7 is a perspective view showing the vicinity of a key mounting part of a frame being a support member and part of a first white key unit mounted thereon, and FIG. 8 is a perspective view of part of a black key unit seen from under.

Figure 9:
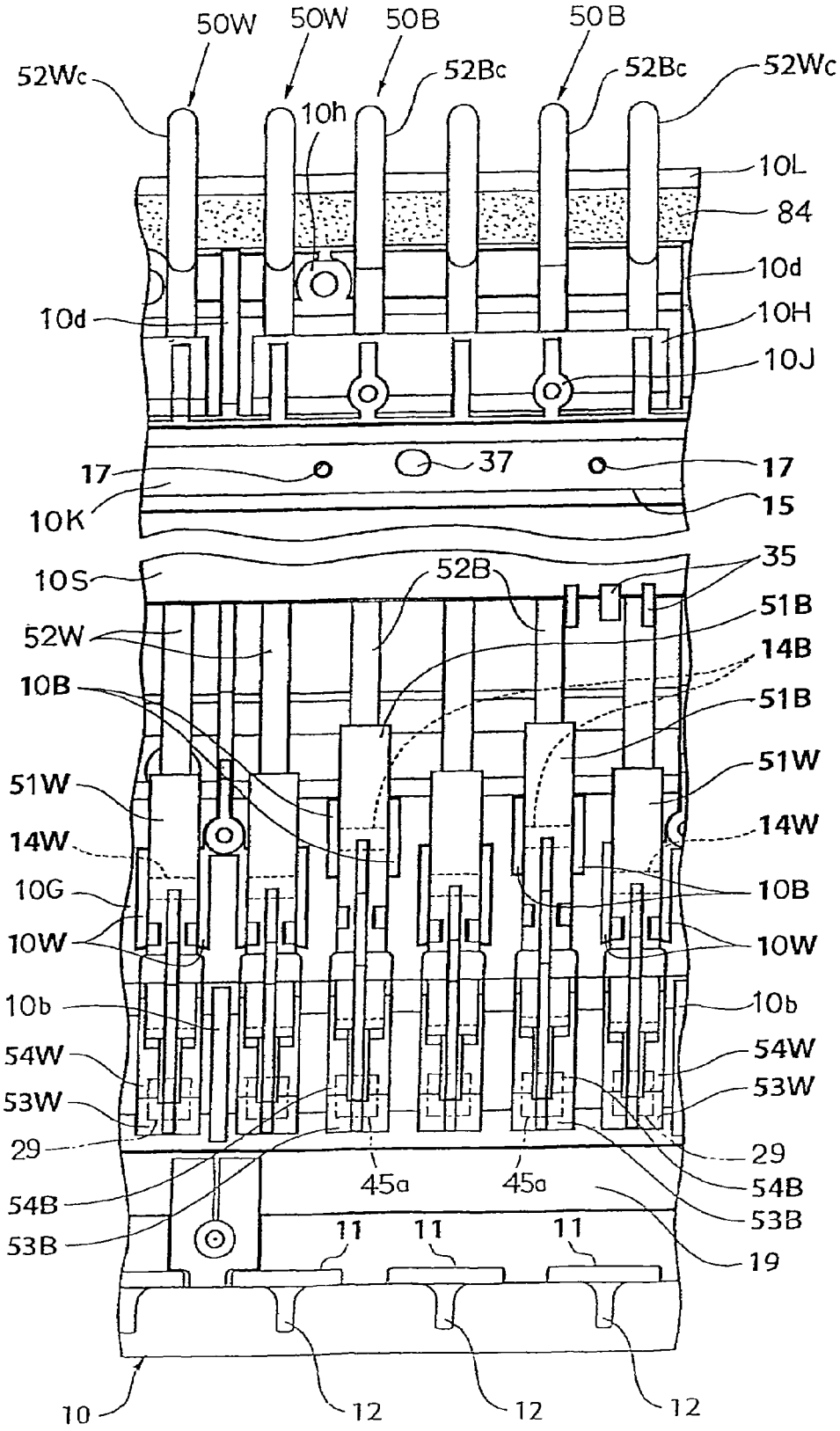
FIG. 9 is a plane view of the keyboard apparatus shown in FIG. 2, partly in cutaway, with the key units and a switch board removed.
Figure 10:
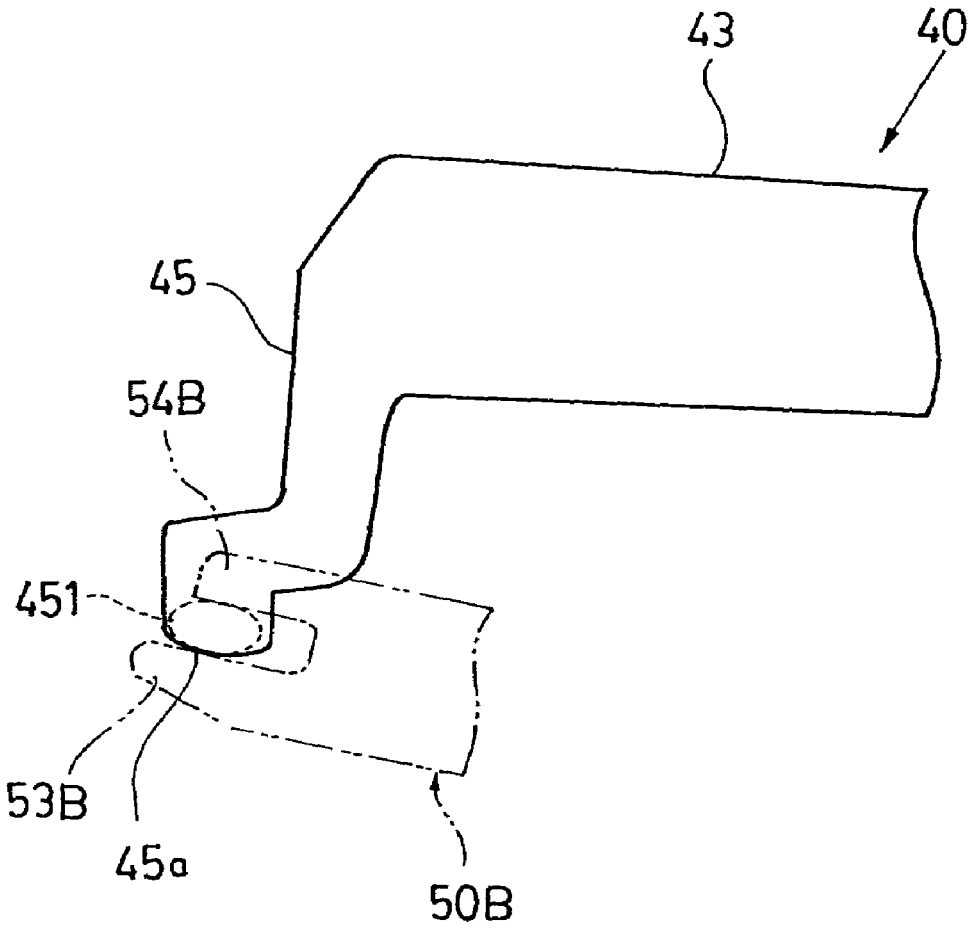
FIG. 10 is a side view of a mass member driving part of a black key.

FIG. 9 is a plane view of the keyboard apparatus shown in FIG. 2, partly in cutaway, with the key units and a switch board removed, and FIG. 10 is a side view of a mass member driving part of a black key.

First, the configuration of the electronic musical instrument shown in FIG. 1 will be mainly described. This electronic musical instrument 1 is an electronic keyboard instrument such as a desktop electronic organ, electronic piano, or synthesizer, and includes a keyboard apparatus 2, an upper case 60, a lower case 70, and electronic circuit parts, a speaker, and so on, which are not shown.

The keyboard apparatus 2 is structured such that many white keys 20 and black keys 40 are mounted on a key mounting part 10K of a frame 10, and is housed in a case composed of the upper case 60 and the lower case 70, with only key main bodies to which a key depression operation is performed being exposed. The upper case 60 and the lower case 70 are engaged with each other, and are fastened to the frame 10 being a key support member with setscrews 71 and a plurality of not-shown setscrews to be coupled to each other.

The upper case 60 has a key slip 64 on its front face and also has on an upper face of its rear portion a music stand mounting groove 61 in which a music stand 62 is inserted for mounting. Rubber legs 76 are attached to four corners of a bottom face of the lower case 70.

The white keys 20 and the black keys 40 in one octave key range compose one set of a key unit KU as shown in, for example, FIG. 5. The key unit KU is composed of a first white key unit KUW1, a second white key unit KUW2, and a black key unit KUB.

The first white key unit KUW1 includes four white keys 20 being whole tone keys (keys C, E, G, B shown in FIG. 2) which are every other keys from an outer side of one octave, and key main bodies 23 of these white keys 20 are coupled to a common key support part 21 via respective coupling parts 24 to be pivotable in a key depression/release direction.

The second white key unit KUW2 includes the other three white keys 20 being whole tone keys (keys D, F, A shown in FIG. 2) which are every other keys, and key main bodies 23 of these white keys 20 are coupled to a common key support part 22 via respective coupling parts 24 to be pivotable in the key depression/release direction.

The black key unit KUB includes black keys 40 (keys C#, D#, F#, G#, A# shown by the solid line in FIG. 2) shown by the virtual line in FIG. 5 which are five half-tone keys, and key main bodies 43 thereof are coupled to a common key support part 41 via respective coupling parts 42 to be pivotable in the key depression/release direction.

In this key unit KU, the coupling parts 24, 42 are key pivoting parts.

In FIG. 5, reference numerals 23, 43 denote the key main bodies of the white keys 20 and the black keys 40 respectively, and needless to say, the key main bodies 23 of the white keys 20 (hereinafter, referred to as "white key main bodies") are longer in the longitudinal length than the key main bodies 43 of the black keys 40 (hereinafter, referred to as "black key main bodies").

Here, "white keys" and "black keys" do not necessarily mean "keys in white color" and "keys in black color", but for convenience' sake, as described above, "white keys" refer to keys whose key main bodies have flat upper faces and longer length and which produce whole tones when depressed, and "black keys" refer to keys whose key main bodies bulge upward from the white keys and have shorter length and which produce half tones when depressed. Therefore, even in a case where black and white colors are reversed in actual keys, keys having the shape and function corresponding to the above-described white keys are called "white keys" and keys having the shape and function corresponding to the above-described black keys are called "black keys".

The respective common key support parts 21, 22, 41 of the first white key unit KUW1, the second white key unit KUW2, and the black key unit KUB are stacked to form a common key support part 30 as shown also in FIG. 6. The common key support part 30 is formed by integrating the common key support parts 21, 22 41 in such a manner that a fitting recessed groove 22*a* formed in the common key support part 22 of the second white key unit KUW2 is fitted in alignment to a fitting protrusion 21*b* in a rail shape formed in the common key support part 21 of the first white key unit KUW1, and a fitting recessed groove 41a formed in the common key support part 41 of the black key unit KUB is fitted in alignment to a fitting protrusion 22*b* in a rail shape formed in the common key support part 22.

Further, a fitting recessed groove 21*a* formed in the common key support part 21 of the first white key unit KUW1 is fitted in alignment to a fitting protrusion 15 in a rail shape formed in the key mounting part 10K of the frame 10. Then, key unit assembly screws 82 shown in FIG. 1 are inserted for assembly from above in mounting holes 26, 26, 44 of the common key support parts 21, 22, 41 forming the common key support part 30 to be screwed in common key support part mounting screw holes 17 of the key mounting part 10K shown in FIG. 6, so that the common key support parts 21, 22, 41 are commonly fixed to the key mounting part 10K.

In this manner, the first white key unit KUW1, the second white key unit KUW2, and the black key unit KUB are assembled on the frame 10 as the key unit KU corresponding to one octave as shown in FIG. 2. The necessary number of the key units KU corresponding to the necessary key range are continuously arranged in a key arrangement direction and are assembled, whereby the keyboard apparatus with the necessary number of keys can be structured.

Here, the shapes and so on of the respective coupling parts 24 of the first and second white key units KUW1, KUW2 and the coupling parts 42 of the black key unit KUB will be described in detail with reference to FIG. 2 and FIG. 5 to FIG. 8.

The coupling part 42 via which each of the black key main bodies 43 of the black key unit KUB is coupled to the common key support part 41 to be pivotable in the key depression direction is made wide, with its total width Wa in the key arrangement direction being wider than a key width Wb of the black key main body 43, as clearly shown in FIG. 2 and FIG. 8, so that parts Wc, Wd (for Wa, Wb, Wc, Wd, refer to FIG. 8) thereof overlap with the coupling parts 24 of the adjacent white keys 20, and the black key 40 is restricted from yawing in the key width direction by the coupling part 42 when depressed/released.

As clearly shown in FIG. 6 and FIG. 8, each of the coupling parts 42 of the black keys 40 is composed of a thin hinge part 42*b* allowing the key to pivot at the time of key depression/release and a thick connecting part 42*a* higher in rigidity than the thin hinge part 42*b*. The thick connecting part 42*a* extends backward from a rear end portion 43*e* (FIG. 8) of the black key main body 43, with both sides thereof protruding from both side faces of the rear end portion 43*e* in the adjacent key directions respectively and is connected to the thin hinge part 42*b* and is further coupled to the common key support part 41 via the thin hinge part. The thin hinge part 42*b* has an opening 47 in its key widthwise middle portion and is divided by the opening 47 into right and left portions, as clearly shown in FIG. 2 and FIG. 8.

The thin hinge part 42*b* thus formed functions with the thick connecting part 42*a* to enhance a sectional secondary moment against a key widthwise (lateral direction) force while increasing flexibility in the key depression direction, so that it is possible to fully restrict yawing in the key width direction of the black key main body 43 without using a key guide.

In the coupling part 42, a protrusion amount of the thick connecting part 42*a* from the both side faces of the rear end portion 43*e* of the black key main body 43 differs depending on each of the black keys 40 as shown in FIG. 2. The right and left protrusion amounts are not necessarily equal and the width thereof differs depending on each key. In any case, the wide part as the black key coupling part of each black key can have an average width corresponding to 12/5=2.4 keys, and the total width thereof in the key width direction is made as wide as possible, thereby increasing the effect of restricting the yawing in the key width direction of the key main body 43.

On the other hand, as for each of the coupling parts 24 via which the white key main bodies 23 of the first and second white key units KUW1, KUW2 are coupled to the respective common key support parts 21 and 22 to be pivotable in the key depression direction, a total width We in the key arrangement direction of the coupling part 24 is narrower than the aforesaid total width Wa in the key arrangement direction of the coupling part 42 of the black key unit KUB and is substantially equal to the width of a rear end portion of the white key main body 23, as clearly shown in FIG. 5 and FIG. 7.

Each of the coupling parts 24 is composed of a thin horizontal hinge part 24*a* extending in the key width direction and a vertical hinge part 24*b* extending in the thickness direction and along the longitudinal direction of the key as shown also in FIG. 6. The vertical hinge part 24*b* is formed in a shape of the character "H" rotated by 90° when seen from above, as clearly shown in FIG. 5. A front end portion of the thin horizontal hinge part 24*a* is integrally connected to the rear end 43*e* of the white key main body 23, and a rear end portion of the vertical hinge part 24*b* is integrally connected to the common key support part 21 or 22.

The horizontal hinge part 24*a* supports the white key main body 23 so as to allow the white key main body 23 to pivot in the key depression direction, and the vertical hinge part 24*b* supports the white key main body 23 so as to allow the white key main body 23 to pivot in the key width direction. Therefore, the positioning in the key arrangement direction of the front end portions of the white key main bodies 23 and the restriction of yawing thereof are realized by later-described guide parts provided on free end sides of the white keys 20.

The reason why the vertical hinge part 24*b* exists is to prevent the occurrence of stress in the key free end portion at the time of the key depression/release even if contraction error at the time of molding and variation among respective parts during the thermal cooling cause slight variation in positional accuracy of a key guide part 12 and/or a guided part 33, which will be described later, because the frame 10 and the key unit KU are formed of resin.

As previously described, the coupling part 42 of the black key 40 has the overlapping portions that partly overlap with the coupling parts 24 of the adjacent white keys 20, with its total width in the key width direction being larger than the key width of the rear end of the black key main body 43, as clearly shown in FIG. 2 and FIG. 5.

Further, as parts of the overlapping portions in the coupling part 42, in the thick connecting part 42*a*, protruding in the adjacent key directions from the both side faces of the rear end portion 43*e* of the black key main body 43 overlap with the upper faces of the rear end portions of the key main bodies 23 of the adjacent white keys 20. Also, as shown in FIG. 6 and FIG. 7, the white key main body 23 has in its rear end portion the escape part 25 that is formed by setting the height of an upper face 23*a* of the rear end portion thereof lower than the height of the other portion. When the black key unit KUB is stacked on the first and second white key units KUW1, KUW2 to form the keyboard apparatus, the thick connecting parts 42*a* which are part of the coupling parts 42 of the black keys 40 are fitted in the escape parts 25 of the white key main bodies 23. In this embodiment, owing to this structure, the upper faces 23*a* of the white key main bodies 23 are flush with upper faces of the thick connecting parts 42*a* of the coupling parts 42 of the black keys 40.

With this structure, in a keyboard apparatus in which no guide part needs to be provided for at least the black keys 40, hinge mechanisms by the coupling parts 24, 42 of the white keys 20 and the black keys 40 are all positioned below the upper faces 23*a* of the white key main bodies 23. This prevents an increase in height and yet enhances a scope for mounting design (panel layout and the like) in the vicinity of fulcrums of the keys. Moreover, since pivotal fulcrums of the black keys 40 and the white keys 20 are vertically close to each other, a keyboard apparatus higher in performability and also key operability could be realized. Particularly, an operation for playing the scales (for example, by keys of C, C#, D, D#, E, F, . . . ) becomes easy.

In addition, it is possible to prevent an increase in height of the keyboard apparatus and yet to increase the thickness of the white key main bodies 23, so that the white key main bodies 23 are prevented from bending when depressed. Further, the key depression becomes close to parallel key depression owing to the increased length of the white key main bodies 23, which enhances performability.

As for the black keys 40, it is possible to secure a sufficient thickness without increasing the height of the thick connecting parts 42*a* of the coupling parts 42, which can enhance rigidity against yawing in the key width direction.

Returning to FIG. 1, the structure of the frame 10 being a support member and its related parts will now be described.

In FIG. 1, the frame 10 is composed of a lower front part positioned on a lower left side, a lower rear part positioned on a lower right side, an upper part positioned on an upper side, and rib parts reinforcing and connecting these parts, and these parts are integrally formed of resin.

In the lower front part, formed are guide support parts 11 with which white key guides 12 are integrally formed, a lower limit stopper support part 1OF for white keys, a key unit slide face 19, a mass member mounting part 10G, boss parts 10*e* to 10*g* for fixing the lower case, and so on. In the lower rear part, a mass member lower limit stopper support part 10L, a boss part 10*h* for fixing the lower case, and so on are provided. Further, in the upper part, a key mounting part 10K, a switch board mounting part 10S, a mass member upper limit stopper support part 10H, an upper component mounting part 10J, and so on are formed.

The key unit slide face 19 is used at the time of the aforesaid mounting of the key unit KU on the frame 10. Specifically, when the key unit KU is inserted through a gap between the guide support parts 11 and the switch board 80 from a front side of the frame 10, lower end faces 29*a*, 45*a* of the later-described mass driving parts 29, 45 being driving parts provided on the white keys 20 and the black keys 40 respectively are brought into contact with and are slid on a slope of the key unit slide face 19, so that fitting parts 291, 451 of the mass member driving parts 29, 45 can be automatically fitted between the main driven parts 53W, 53B and the sub driven parts 54W, 54B of the later-described white key mass members 50W and black key mass members 50B.

Therefor, the top and bottom surfaces of the fitting parts 291, 451 are fitted between the main driven parts 53W, 53B and the sub driven parts 54W, 54B, the power between the keys and the mass members are transmitted in the both direction of key depression/release.

Components such as an operation panel board housed in the upper part of the upper case 60 can be mounted on the upper component mounting part 10J.

Each of the rib parts is composed of: a rib 10*a* under the white key lower limit stopper support part 10F and the key unit slide face 19; a rib 10*b* above the boss part 10*f*; a rib 10*c* on an inner side of the mass member mounting part 10G, and a main rib 10*d* connecting the lower front part, the lower rear part, and the upper part. The plural rib parts (about two per one octave) each composed of these ribs extend along the key longitudinal direction and are arranged at intervals in the key arrangement direction, as shown in FIG. 2.

On an upper face of the white key lower limit stopper support part 10F, a white key lower limit stopper 34 made of a belt-shaped felt material and extending in the key arrangement direction is pasted and held. On an upper face of the mass member lower limit stopper support part 10L, a mass member lower limit stopper 84 made of a belt-shaped felt material and extending in the arrangement direction of the later-described mass members (hammers) 50W, 50B is pasted and held, as shown also in FIG. 2 and FIG. 9. Further, on a lower face of the mass member upper limit stopper support part 10H, a mass member upper limit stopper 83 made of a belt-shaped felt material and extending in the arrangement direction of the mass members 50W, 50B is pasted and held as shown also in FIG. 7.

Here, the guide parts of the white keys will be described with reference to FIG. 2 to FIG. 4.

On an upper portion on a front end side of the frame 10, the plate-shaped guide support parts 11 are arranged at positions corresponding to the vicinities of the free ends of the respective white keys along the arrangement direction of the white keys 20 as shown in FIG. 2 and FIG. 3. The plate-shaped white key guides 12 are formed vertically to protrude forward from front faces of the respective guide support parts 11. The guide support parts 11 and the white key guides 12 form T-shaped guide members when seen from above or from under as shown in FIG. 2 by the broken line and in FIG. 4 by the virtual line.

In a tip portion 20*a* of the white key main body 23 on the free end side of each of the white keys 20, as shown in FIG. 4 where the bottom view thereof is shown, an outer front end wall 31 is provided in a front end which is a portion seen from outside when the keyboard apparatus 2 is housed in the case. An upper face portion protrudes slightly forward therefrom. An inner front end wall 32 is formed on an inner side of the outer front end wall 31 to have the same height as the entire height of the tip portion 20*a* of the white key main body 23. In a key widthwise middle portion of the inner front end wall 32, a slit 33*a* extending from a lower end along the key height direction is formed and a pair of guided parts 33 bending and protruding forward are formed symmetrically. A gap width of the slit 33*a* of the guided parts 33 is slightly larger than the thickness of the white key guide 12.

At the time of the aforesaid mounting of the key unit KU on the frame 10, the white key guides 12 are inserted in the slits 33*a* of the guided parts 33 of the respective white keys 20 as shown in FIG. 2 to FIG. 4, thereby positioning the tip portions of the white keys 20 and restricting yawing at the time of the key depression. Incidentally, since the white key main bodies 23 are pivotable in the key width direction owing to the function of the aforesaid vertical hinge parts 24*b* of the coupling parts 24, it is possible to easily align the arrangement positions of the white key main bodies 23 even with a slight manufacturing error or a slight assembly error, which realizes a smooth key depression/release operation. Preferably, the white key guides 12 and the guided parts 33 of the white keys 20 are coated with lubricating grease.

Returning again to FIG. 1, the switch board 80 is hooked by a switch board locking hook 35 to be mounted on the switch board mounting part 10S of the frame 10. On the switch board 80, many key switches 81 are arranged at positions corresponding to longitudinal middle portions of the white keys 20 and the black keys 40, as shown also in FIG. 2 by the broken lines.

Each of the key switches 81 has a dome-shaped movable part made of synthetic rubber. The movable part has a pair of pressed parts (two small circles shown by the broken lines in FIG. 2) and has, on an inner side of the pair of the pressed parts, a pair of movable contacts made of conductive rubber, and the respective movable contacts face two sets of fixed contacts formed on the switch board 80 to constitute a two-contact (two-make) key switch. When the white key 20 or the black key 40 is depressed, the bottom face thereof presses the movable part, so that the pair of movable contacts sequentially touch the two sets of fixed contacts to turn ON the contacts, and accordingly, a key depression signal is outputted. Further, from a time difference between the timings at which the contacts turn ON, a key depression speed can be detected, and musical sound to be generated can be controlled according to the detected key depression speed.

Next, since the keyboard apparatus 2 includes the mass members (generally called hammers) operating in linkage with the respective keys so as to provide a heavy touch feeling when the keys are depressed, the mass members will be described with reference to FIG. 2, FIG. 9, and FIG. 10 in addition to FIG. 1.

The white key mass member 50W for the each of white keys 20 and the black key mass member 50B for the each of black keys 40 are pivotally mounted respectively on the mass member mounting part 10G of the frame 10 via later-described mass member pivoting parts (pivot shafts 14W, 14B) in the arrow M direction in FIG. 1.

The white key mass members 50W and the black key mass members 50B have substantially the same structure as follows. In each of them, a pivot supported part 51W or 51B, the main driven part 53W or 53B, and the sub driven part 54W or 54B are integrally formed of resin to constitute a driving force transmitting part. A front end portion of an inertia moment generating part 52W or 52B made of a bar-shaped metal material such as an iron material is integrated with the pivot supported part 51W or 51B by outsert molding.

By a bending process, each rear end portion of the inertia moment generating part 52W or 52B is bent upward substantially at a right angle to form an upward extension part U extending upward along the pivot direction, and is further bent substantially at a right angle toward a later-described connecting part so as to return forward to form a parallel part P. The rear end portion of the inertia moment generating part 52B of the black key mass member 50B forms a C-shaped mass concentration part 52Bc. The rear end portion of the inertia moment generating part 52W of the white key mass member 50W is further bent downward substantially at a right angle to form a mass concentration part 52Wc in a substantially rectangular loop shape.

The mass concentration parts 52Wc and 52Bc extend more outward (backward) in the key longitudinal direction than the mass member upper limit stopper support part 10H of the frame 10, and at the highest lifted positions, that is, when the inertial moment generating parts 52W, 52B abut on the mass member upper limit stopper 83, upper faces thereof become substantially flush with the upper faces of the key main bodies 43 of the white keys 20 or the upper faces of the thick connecting parts 42*a* of the black keys 40. Portions in front of the mass concentration parts 52Wc, 52Bc in the inertia moment generating parts 52W, 52B are connecting parts connecting the mass concentration parts 52Wc, 52Bc to the aforesaid driving force transmitting parts.

In the pivot supported parts 51W, 51B of the respective mass members 50W, 50B, provided are bearing parts (mass member pivoting part corresponding part corresponding to the mass member pivoting part on the frame side) 13W, 13B forming recessions in a radial direction and having guide tongue pieces Q which protrude backward from lower sides of the recessions. As shown also in FIG. 9, on an upper face of the mass member mounting part 10G of the frame 10, pairs of support ribs 10W and pairs of support ribs 10B parallel to the key longitudinal direction are integrally provided, the support ribs 10W or 10B in each pair facing at a predetermined interval in the key width direction, and each of the pivot shafts 14W, 14B being the mass member pivoting parts is bridged between the pair of support ribs. As shown in FIG. 2, openings 38, 48 are formed in the mass member mounting part 10G to allow mold dies to be put therein when the pivot shafts 14W, 14B are molded. In FIG. 1, the front-side support ribs of the pairs of support ribs 10W are omitted.

The pivot shafts 14W, 14B being the mass member pivoting parts are inserted in the recessions of the bearing parts 13W, 13B being the mass member pivoting part corresponding parts of the respective mass members 50W, 50B, so that the white key mass members 50W are pivotably supported by the mass member mounting part 10G via the bearing parts 13W, the pivot shafts 14W and the pairs of support ribs 10W, and the black key mass members 50B are pivotably supported by the mass member mounting part 10G via the bearing parts 13B, the pivot shafts 14B and the pairs of support ribs 10B.

The pivot support position, namely, the position of the pivot shafts 14W in terms of the key longitudinal direction is different from that of the pivot shafts 14B as is seen from FIG. 2 and FIG. 9, and the pivot shafts 14W for the white key mass members 50W are positioned closer to a front end than the pivot shafts 14B for the black key mass members 50B.

As shown in FIG. 1, in front end portions of the white key mass members 50W, the main driven parts 53W and the sub driven parts 54W are provided at an interval in the vertical direction to be integrated with the pivot supported parts 51W, and the main driven parts 53W protrude more forward than the sub driven parts 54W. Further, as shown in FIG. 1, the mass driving parts 29 are provided on the lower faces near the rear end portions of wide portions shown in FIG. 4 of the each of white keys 20 to protrude straight downward. Lower end faces of the mass member driving parts 29 abut on upper faces of the main driven parts 53W of the corresponding white key mass members 50W. Further, lower portions of the mass member driving parts 29 are hollow with rear faces thereof being open, and front end portions of the sub driven parts 54W are loosely inserted in the hollow portions as shown by the broken line in FIG. 1.

With the above-described structure, a heavy touch feeling is given when the white key 20 is depressed, because the mass member driving part 29 goes down to drive the main driven part 53W, so that the white key mass member 50W pivots on the pivot shaft 14W serving as a fulcrum, counter-clockwise in FIG. 1 up to the position shown by the virtual line, at which time a part C of the inertia moment generating part 52W abuts on the mass member upper limit stopper 83. When the key release, a lower end inner wall of the mass member driving part 29 is engaged with and lifts the sub driven part 54W, so that the white key mass member 50W pivots clockwise in FIG. 1 on the pivot shaft 14W serving as a fulcrum to quickly return to the position shown by the solid line, at which time the mass concentration part 52Wc abuts on the mass member lower limit stopper 84.

In this manner, the mass member driving parts 29 are engaged with the main driven parts 53W and the sub driven parts 54W of the white key mass members 50W so that the white keys 20 and the white key mass members 50W always operate in linkage each other to pivot.

Similarly, in a front end portion of each of the black key mass members 50B, the main driven part 53B and the sub driven part 54B shown by the virtual lines in FIG. 10 are provided at an interval in the vertical direction to be integrated with the pivot supported part 51 B (see FIG. 9), and the main driven part 53B protrudes more to the front side than the sub driven part 54B. Further, as shown in FIG. 10, on a bottom face of a front end portion of each of the black keys 40, the mass member driving part 45 is protrudingly provided. The mass member driving part 45 is cranked downward, forward, and downward to have its lower end face 45*a* abut on an upper face of the main driven part 53B of the corresponding black key mass member 50B, and the position in the key longitudinal direction of the mass member driving part 45 is aligned with the position where the lower end face of the white key mass member driving part 29 abuts on the main driven part 53W of the white key mass member 50W, as shown by the virtual line in FIG. 9.

A lower end portion 45*a* of the mass member driving part 45 is also hollow, with a rear face thereof open, and a front end portion of the sub driven part 54B is loosely inserted therein as shown by the virtual line in FIG. 10.

Consequently, similarly to the above-described case of the white keys 20 and the white key mass members 50W, the black keys 40 and the black key mass members 50B also always operate in linkage with each other when pivoting.

In this embodiment, the mass member driving parts 45 extend forward under the white keys 20 as described above, so that the driving positions in the key longitudinal direction of the white key mass members 50W and the black key mass members 50B by the mass member driving parts 29, 45 of the white keys 20 and the black keys 40 become substantially the same. On the other hand, the positions in the key longitudinal direction of the pivot shafts 14W and 14B serving as pivotal fulcrums of the white key mass members 50W and the black key mass members 50B are different (they are staggered arrangement).

Therefore, the distance from points where the black key mass members 50B are driven by the mass member driving parts 45 to the pivotal fulcrums are longer than the distance from points where the white key mass members 50W are driven by the mass member driving parts 29 to the pivotal fulcrums, and the distance from the pivotal fulcrums of the inertia moment generating parts 52B of the black key mass members 50B to the parts C abutting on the mass member upper limit stopper 83 is shorter than the distance from the pivotal fulcrums of the inertia moment generating parts 52W of the white key mass members 50W to the parts C abutting on the mass member upper limit stopper 83. This realizes good balance between the white keys 20 and the black keys 40 in terms of key depression feeling.

The following description will be on reasons why the white key mass members 50W and the black key mass members 50B in this embodiment are structured, as described above, such that the mass concentration parts 52Wc and 52Bc extend more outward (backward) in the key longitudinal direction than the mass member upper limit stopper support part 10H of the frame 10, and at the highest lifted position, namely, when the inertia moment generating parts 52W, 52B abut on the mass member upper limit stoppers 83, the upper faces thereof become substantially flush with the upper faces of the key main bodies 43 of the white keys 20 or with the upper faces of the thick connecting parts 42*a* of the black keys 40.

In a piano system keyboard apparatus with mass members (hammers), balancing with a mounting space is important for realizing a good key depression touch feeling. In particular, a musical instrument in a lower price range has a larger dimensional restriction of an instrument main body and thus involves a higher possibility that performance as a keyboard has to be sacrificed, and therefore, achieving the highest possible space efficiency under such a restriction is essential. Arranging the minimum necessary members and other functional components at the same height can eliminate an excessive space. What is especially important is that a movement amount of the mass members (hammers) almost determines the height of a unit.

Therefore, by making the mass concentration parts of the mass members extend more outward in the key longitudinal direction than the mass member upper limit stopper support part of the frame, it is possible to realize both improved equivalent mass and reduced weight of the mass members as well as resulting cost reduction.

Feeling of mass is proportional to a square of the distance from a pivotal fulcrum to a gravity center of a mass member, and therefore, the mass concentration part is preferably positioned as far as possible from the pivotal fulcrum. For this purpose, the mass concentration parts are made to protrude from the frame, and further upper ends of the mass concentration parts are positioned at the same height as the highest point of the frame and the keys when the mass members pivot upward. This makes it possible both to improve a touch feeling and to secure the scope for mounting at a higher level.

Further, the upper limit position of the mass member 50W or 50B at the time of key depression is restricted in such a manner that the touching part C, in the connecting part that is not extending upward, in the inertia moment generating part 52W or 52B, closer to the pivot center than the mass concentration part 52Wc or 52Bc, touches with the mass member upper limit stopper 83, and therefore, the pivot angle can be increased even if the position of the mass member upper limit stopper 83 is lower than a conventional height. Also in this respect, a key touch feeling at the time of key depression is made heavier, so that a desired touch feeling can be easily obtained.

Therefore, the mass concentration parts 52Wc, 52Bc of the mass members 50W, 50B shown in FIG. 1 are provided at positions opposite the mass member driving parts 29, 45 across the bearing parts 13W, 13B being the corresponding parts of the mass member pivoting parts (the pivot shafts 14W, 14B) and more distant from the bearing parts 13W, 13B being the corresponding parts than the mass member driving parts 29, 45.

Further, the mass concentration parts 52Wc, 52Bc extend more outward in the key longitudinal direction than the position where the mass member upper limit stopper 83 on the frame 10 is disposed, and the upper faces of the mass concentration parts at the highest lifted position are positioned between the upper faces 23*a* of the white key main bodies 23 and the lower face of the mass member upper limit stopper support part 10H supporting the mass member upper limit stopper 83 on the frame 10.

Another possible structure is such that the mass concentration parts 52Wc, 52Bc are provided at the outermost portion that is the farthest position from the bearing parts 13W, 13B being the corresponding parts and has the upward extension parts U being rising parts rising from the outermost portions, and the rising parts are positioned higher than the mass member upper limit stopper 83 when the mass concentration parts 52Wc, 52Bc are at the highest lifted position, with upper ends thereof being positioned lower than the upper faces of the black key main bodies 43.

Further, in this embodiment, the mass concentration parts 52Wc, 52Bc of the mass members 50W, 50B are made of the bar-shaped metal members whose rear end portions are bent upward in the key depression/release direction and further bent toward the connection parts. This structure makes it possible to increase an inertia moment by increasing equivalent weight without making the whole length of the mass members 50W, 50B very long, leading to an improved touch feeling. In addition, since each of the mass concentration parts 52Wc, 52Bc is bent in a space having a width equal to the diameter of the bar-shaped metal member and parallel to the key depression/release direction (in a vertical plane including the connecting part), it is possible to avoid interference with the mass members of the adjacent keys and make efficient use of an upper space.

This bent shape of the mass concentration parts 52Wc, 52Bc is not limited to a C-shape or a rectangular shape but may be various shapes such as a U-shape, a triangular shape, a circular shape, and a spiral shape. Concrete examples thereof will be described later.

Further, in this embodiment, each of the mass concentration parts 52Wc of the white key mass members 50W is formed by bending the bar-shaped metal material so as to have a quadrangular side shape as shown in FIG. 1, and each of the mass concentration parts 52Bc of the black key mass members 50B is formed by bending the bar-shaped metal material so as to have a C-shaped side shape, though not clearly seen in FIG. 1. In this manner, the mass concentration parts 52Wc, 52Bc of the white key mass members 50W and the black key mass members 50B are different in effective length (length when they are stretched=weight) from each other, so that the white keys 20 and the black keys 40 are equal in touch feeling.

Further, in the keyboard apparatus 2 of this embodiment, the components of the frame 10 are supported by the many ribs to be integrated as described in FIG. 1. At least part of lower edges of the largest ribs 10*d* among these ribs (middle portions along the key longitudinal direction in the example in FIG. 1) are formed along lower edges of the mass members 50W, 50B positioned at the lowest descended state shown by the solid line. This structure enables effective use of a space formed in a lower part of the frame 10. For example, functional components and so on that are long in the arrangement direction of the keys and the mass members (key width direction) can be easily disposed.

In this case, the pivotal fulcrum portions by the bearing parts 13W, 13B of the mass members 50W, 50B and by the pivot shafts 14W, 14B on the mass member mounting part 10G side are provided at a predeteremined height position from the lowest end of the frame 10 being the support member, whereby a space not including the movement range of the mass members 50W, 50B. is formed under the mass members 50W, 50B, and the highest part of the space coincides with part of the lower edges of the ribs 10*d*.

Moreover, indented portions indented into this space are formed in the lower case 70 mounted on the lower end of the frame 10, and the recessed portions can serve as functional member housing parts. In the example shown in FIG. 1, one of the recessed portions is used as a battery chamber 18 housing batteries or a battery pack, and a cover 75 is detachably provided therein.

With this structure, in a case of a portable electronic keyboard instrument, it is possible to put necessary batteries or a battery pack containing batteries without providing extra space (without enlarging the dimension in the height direction of the keyboard apparatus).

Another recessed portion is used as a functional component housing part 16 and various kinds of functional components that are long in the key arrangement direction can be housed therein. The functional component housing part 16 can also be used as a part in which a temporary support member used when the frame 10 is fitted in the lower case 70 is inserted or as a part for housing accessories such as cords and microphones.

The lower case 70 is fixed to the boss parts 10*f*, 10*g*, 10*h* of the frame 10 with setscrews 72, 73, 74.

It is also possible to integrate the frame 10 and the lower case 70 and make part of the lower case support the key unit and the mass members.

Further, only dispersed two or three places of the bottom face of the frame 10 being the support member constitute the lowest end of the frame 10. In the example shown in FIG. 1, only the bottom faces of the boss parts 10*f*, 10*h* constitute the lowest end of the frame 10 and the other portions are higher than the lowest end. For example, a bottom face of the boss part 10g is slightly higher than the bottom face of the boss part 10*f*. When two places constitute the lowest end, at least one of them needs to have a certain length.

With this structure, the keyboard apparatus 2 does not wobble and can be stably set when it is directly placed on a key bed of a keyboard instrument without mounting the lower case 70.

Here, features of the mass members in the keyboard apparatus according to the invention and other examples of the shape of the mass concentration parts will be described with reference to FIG. 11, FIG. 12, and FIG. 13A to FIG. 13F.

Figure 11:
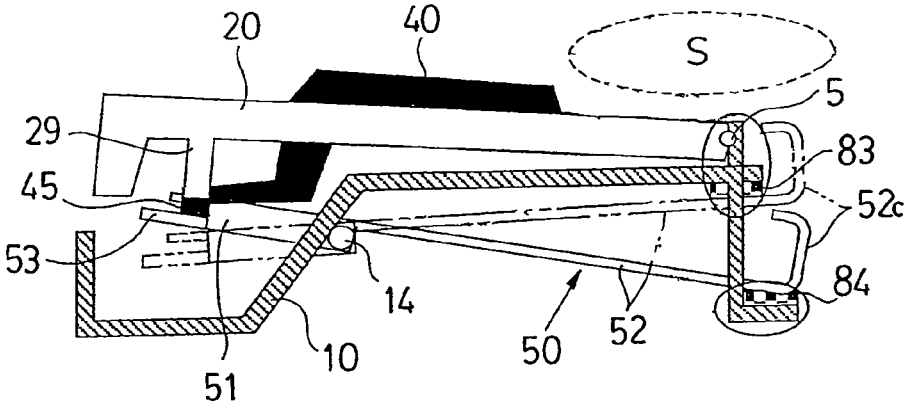
FIG. 11 is a simplified side view showing an example of a keyboard apparatus according to the invention where a mass member has a different shape.
Figure 12:
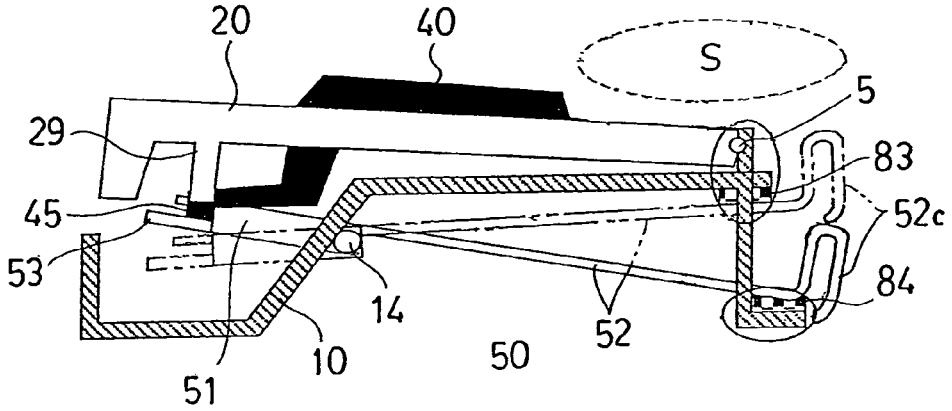
FIG. 12 is a simplified side view of an example of the keyboard apparatus where the mass member has a still different shape.

FIG. 11 and FIG. 12 are simplified side views showing examples where the mass members of the keyboard apparatus according to the invention have different shapes. In these drawings, the mass member for the white key and the mass member for the black key are not discriminated by different reference symbols, but they are denoted by the reference symbol in the previously described drawings without "W" and "B".

In the example shown in FIG. 11, a white key 20 and a black key 40 are pivotably supported on a frame 10 via a key pivoting parts 5 respectively. Under the white keys 20 and the black keys 40, mass members (hammers) 50 are pivotably supported by pivot shafts 14 provided on the frame 10 side, respectively. When the white key 20 or the black key 40 is depressed, a mass member driving part 29 or 45 provided thereunder drives a driven part 53, so that the mass member 50 pivots from the position shown by the solid line to the position shown by the virtual line.

This mass member 50 has: an inertia moment generating part 52 made of a bar-shaped metal material with a predetermined length; and a driving force transmitting part which includes a pivot supported part 51 supporting the inertia moment generating part 52 and a driven part 53 and whose distance from a pivotal fulcrum is shorter than the length of the inertia moment generating part 52. The inertia moment generating part 52 is composed of a mass concentration part 52*c* and a connecting part connecting the mass concentration part 52*c* to the driving force transmitting part. The mass concentration part 52*c* extends more outward in the key longitudinal direction than the position where a mass member upper limit stopper 83 on the frame 10 is disposed and has a part extending upward along the pivot direction. In the example shown in the drawing, the mass concentration part 52*c* has a part made by further bending an end portion thereof toward the connecting part side.

A pivot range of each of the mass members 50 when the white key 20 or the black key 40 is driven and is not driven is restricted by a mass member lower limit stopper 84 provided in a lower portion of the frame 10 and by a mass member upper limit stopper 83 provided in an upper portion of the frame 10.

An upper face of the mass concentration part 52*c* of each of the mass members 50 at the highest lifted position is substantially flush with an upper face of the white key 20 and an upper face of a rear end portion of the black key 40.

With this structure, in this keyboard apparatus, the mass concentration part 52*c* of the mass member 50 can be freely changed in shape by a thickness from the mass member upper limit stopper 83 to the upper face of the white key 20 (a height range surrounded by the solid line oval in FIG. 11), which makes it possible to increase the mass of the mass concentration part 52*c*. Accordingly, it is possible to prevent an increase in the total length of the mass member 50 yet increase the distance from the pivot shaft 14 (pivot center) to the gravity center being the mass center (increase equivalent mass), thereby increasing an inertia moment. Further, at the time of key depression, the upper limit position of each of the mass members 50 is restricted in such a manner that a not extending upward portion of the inertia moment generating part 52 closer to the pivot center than the mass concentration part 52*c* and touches with the mass member upper limit stopper 83, so that a pivot angle thereof also increases. Therefore, it is possible to make a key touch feeling heavy when the key is depressed, so that a desired touch feeling can be easily obtained.

Moreover, since the rear end portions of the mass members 50 do not protrude upward from the upper faces of the rear end portions of the white keys 20 and the black keys 40 even when the mass members 50 are at the highest lifted position, it is possible to make the keyboard rear portion flat and low in height, and since it is not necessary to increase the total length of the mass member, it is also possible to prevent an increase in depth of the keyboard apparatus. Therefore, a scope for mounting design in the area S in the upper rear portion of the keyboard surrounded by the broken line in FIG. 11 is enhanced, which makes it possible to provide a compact and high-performance keyboard apparatus.

Incidentally, if the mass concentration part 52*c* is formed by bending upward in a vertical plane including the connecting part of the inertia moment generating part 52 made of the bar-shaped metal material, there is no portion extending in the key width direction, which totally eliminates the interference with the mass members 50 for the adjacent keys, thereby enabling effective use of the upper space.

The example shown in FIG. 12 is different from the example shown in FIG. 11 only in the shape of the mass concentration part 52*c* of the mass member 50.

The mass concentration part 52*c* of this example is formed by bending a rear end portion of the inertia moment generating part 52, in the mass member 50, made of the bar-shaped metal material to a reversed U-shape in a space having the same width as the diameter of the bar and parallel (vertical) to the pivot direction, and the mass concentration part 52*c* is thus slightly extended into the upper space but also into a lower space, whereby equivalent weight is increased. The other structure and operation are the same as those in the example described with reference to FIG. 11.

Figure 13A:
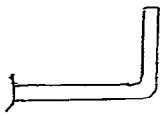
FIG. 13A to FIG. 13F are side sectional views showing various examples of the shape of the mass concentration part in the mass member of the keyboard apparatus according to the invention.
Figure 13B:
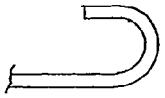
Figure 13C:
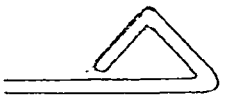
Figure 13D:
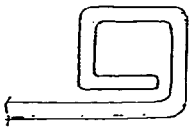
Figure 13E:
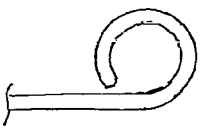
Figure 13F:
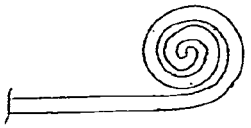

FIG. 13A to FIG. 13F are side views showing various examples of the shape of the mass concentration part of the mass member. As the examples of the shape, FIG. 13A shows an L shape, FIG. 13B a hook shape, FIG. 13C a triangular shape, FIG. 13D a quadrangular shape with one side thereof overlapping with another, FIG. 13E a circular loop shape, and FIG. 13F a spiral shape.

In a case where the inertia moment generating part of the mass member is made of the bar-shaped metal material and the rear end portion thereof is bent to form the mass concentration part as described above, the number of bending times, and length of respective bent portions, bending angle and curvature of respective bent portions, and the number of spirals in the case of the spiral shape can be appropriately determined as required.

Further, the inertia moment generating part having the mass concentration part in the mass member is not limited to that formed by bending the bar-shaped metal material but can be fabricated by pressing a metal plate, by casting a metal material, and the like.

The invention is applicable not only to electronic keyboard instruments but also to electric keyboard instruments using acoustic sound generators and other keyboard instruments including mass members. It goes without saying that the shapes and arrangements of the components are not limited to those in the embodiment, but may be appropriately changed according to the specifications of musical instruments to which the invention is applied.

The keyboard apparatus according to the invention is applicable to various kinds of keyboard instruments, for example, electronic keyboard instruments such as electronic organs, electronic pianos, and synthesizers, and electric keyboard instruments. In particular, the keyboard apparatus according to the invention is suitably applicable to a small-type electronic keyboard instrument including mass members (hammers) for respective keys, and it is possible to provide a high-performance, compact electronic keyboard instrument with a good key touch feeling at low cost.

What is claimed is:

1. A keyboard apparatus comprising:

a frame having a key mounting part and a mass member mounting part;

keys composed of white keys and black keys that are pivotably supported on the key mounting part via key pivoting parts;

mass members that are driven by driving parts provided underside of the keys and are supported pivotably on the mass member mounting part via mass member pivoting parts; and a mass member lower limit stopper and a mass member upper limit stopper that are provided on said frame to restrict a pivot range of said mass members when said keys are driven and when said keys are not driven, wherein each of said mass members includes a mass concentration part that extends more outward in a key longitudinal direction than a position where said mass member upper limit stopper on said frame is disposed, and an upper face of the mass concentration part at a highest lifted position is substantially flush with an upper face of a main body rear end portion of the white key.

2. A keyboard apparatus comprising:

a support member;

keys pivotably supported on said support member; and mass members that are provided below the keys to be pivotably supported on said support member and is driven to pivot via a driving part provided underside of the key, wherein each of said mass members includes: an inertia moment generating part made of a bar-shaped metal material with a predetermined length; and a driving force transmitting part which includes a driven part driven by the driving part and a supported part pivotably supported and whose length from a pivotal fulcrum is shorter than a length of the inertial moment generating part, wherein the inertial moment generating part is composed of a mass concentration part and a connecting part connecting the mass concentration part to the driving force transmitting part, and wherein the mass concentration part extends more outward in a key longitudinal direction than a mass member upper limit stopper restricting an upper limit of pivoting of said mass member and has an upward extension part that extends upward along a pivot direction of said mass member.

3. A keyboard apparatus according to claim 2, wherein the mass concentration part further has a parallel part folded from the upward extension part toward the connecting part.

4. A keyboard apparatus according to claim 2, wherein the mass concentration part is formed by bending the bar-shaped metal material to a circular shape or to an arc shape in a vertical plane including the connecting part.

5. A keyboard apparatus according to claim 2, wherein a plurality of the keys are pivotably supported on said support member and said mass members are provided in correspondence to said plural keys respectively, and wherein depending on each group of said plural keys or depending on each of said keys, at least one of an effective length and a shape of the mass concentration part in said corresponding mass member is made different.

6. A keyboard apparatus comprising:

a frame having a key mounting part and a mass member mounting part;

keys composed of white keys and black keys that are pivotably supported on the key mounting part via key pivoting parts;

mass members that are driven by driving parts provided underside of the keys and supported pivotably on the mass member mounting part via mass member pivoting parts; and a mass member lower limit stopper and a mass member upper limit stopper that are provided in said frame to restrict a pivot range of said mass members when said keys are driven and when said keys are not driven, wherein each of said mass members includes a mass concentration part provided at a position which is opposite the driving part across a corresponding part of the mass member pivoting part and whose distance from the corresponding part is longer than a distance between the corresponding part and the driving part;

wherein the mass concentration part extends more outward in a key longitudinal direction than a position where said mass member upper limit stopper of said frame is disposed, and wherein an upper face of the mass concentration part at a highest lifted position is positioned between an upper face of the white key and a lower face of a support part supporting said mass member upper limit stopper on said frame.

7. A keyboard apparatus comprising:

a frame having a key mounting part and a mass member mounting part;

keys composed of white keys and black keys that are pivotably supported on the key mounting part via key pivoting parts;

mass members that are driven by driving parts provided underside of said keys and are supported pivotably on the mass member mounting part via mass member pivoting parts; and a mass member lower limit stopper and a mass member upper limit stopper that are provided on said frame to restrict a pivot range of said mass members when said keys are driven and when said keys are not driven, wherein each of said mass members includes a mass concentration part, and said mass concentration part is provided at an outermost portion that is a farthest position from a corresponding part and in opposite the driving part across the corresponding part of the mass member pivoting part, and whose distance from the corresponding part is longer than a distance between the corresponding part and the driving part, and said mass member has a rising part rising from the outermost portion, and wherein, when the mass concentration part is at a highest lifted position, the rising part is positioned higher than said mass member upper limit stopper, with an upper end thereof being lower than an upper face of a main body of the black key.

* * * * *